United States Patent [19]

Gartner

[11] Patent Number: 4,745,721

[45] Date of Patent: May 24, 1988

[54] METHOD OF ATTACHING WINDOW UNITS

[75] Inventor: Karl Gartner, Gundelfingen, Fed. Rep. of Germany

[73] Assignee: Yoshida Kogyo K. K., Tokyo, Japan

[21] Appl. No.: 808,266

[22] Filed: Dec. 12, 1985

Related U.S. Application Data

[62] Division of Ser. No. 516,316, Jul. 22, 1983, abandoned.

[30] Foreign Application Priority Data

Jul. 27, 1982 [JP] Japan ..... 57-113502
Jul. 27, 1982 [JP] Japan ..... 57-113503
Jul. 27, 1982 [JP] Japan ..... 57-130850

[51] Int. Cl.[4] ..... E06B 1/04

[52] U.S. Cl. ..... 52/741; 52/126.5; 52/210; 52/217

[58] Field of Search ..... 52/126.1, 126.5, 126.6, 52/126.7, 206, 210, 211, 217, 741, 788, 656, 745; 49/505, DIG. 1, 62

[56] References Cited

U.S. PATENT DOCUMENTS

| | | | |
|---|---|---|---|
| 1,905,124 | 4/1933 | Baum | 52/211 |
| 2,138,958 | 12/1938 | Corbett et al. | 52/293 |
| 2,482,170 | 4/1949 | Gunnison | 52/97 |
| 2,612,660 | 10/1952 | Casey | 49/422 |
| 2,774,997 | 12/1956 | Zitomer | 49/505 |
| 2,856,040 | 10/1958 | Dansereau | 49/505 |
| 2,968,374 | 1/1961 | Bohnsack | 52/293 |
| 3,386,216 | 6/1968 | Zwickert | 52/213 |
| 3,537,219 | 11/1970 | Navarre | 52/213 |
| 3,553,891 | 1/1971 | Casebolt | 49/505 |
| 3,638,387 | 2/1972 | Lickliter et al. | 52/741 |
| 3,992,833 | 11/1976 | Hulinsky | 52/206 |
| 3,994,243 | 11/1976 | Anders | 109/2 |
| 4,023,326 | 5/1977 | Azuma et al. | 52/217 |
| 4,287,691 | 9/1981 | Guenther | 52/97 |
| 4,372,082 | 2/1983 | Pagel | 49/62 |
| 4,495,687 | 1/1985 | Sieveking | 52/214 |

FOREIGN PATENT DOCUMENTS

| | | | |
|---|---|---|---|
| 1098180 | 8/1958 | Fed. Rep. of Germany | 52/217 |
| 2245155 | 3/1974 | Fed. Rep. of Germany | 49/505 |
| 2538632 | 3/1976 | Fed. Rep. of Germany | 52/213 |
| 2626674 | 12/1977 | Fed. Rep. of Germany | 49/DIG. 1 |
| 6716099 | 5/1968 | Netherlands | 52/126.6 |
| 6801994 | 8/1969 | Netherlands | 52/235 |
| 440649 | 12/1967 | Switzerland | 52/217 |
| 814893 | 6/1959 | United Kingdom | 52/741 |
| 2102112 | 1/1983 | United Kingdom | 52/235 |

*Primary Examiner*—John E. Murtagh
*Assistant Examiner*—Andrew Joseph Rudy
*Attorney, Agent, or Firm*—Hill, Van Santen, Steadman & Simpson

[57] ABSTRACT

A window unit has a plurality of adjustable anchors fixed to a bottom rail thereof. When the window unit is mounted in a building opening, a top rail thereof is received in a channel-shaped frame secured to an upper edge of the building opening and the adjustable anchors are each placed on an attachment base plate secured to a lower edge of the building opening. Then the adjustable anchors are adjusted to adjust the window unit in position between the upper and lower edges, and thereafter are welded or otherwise fastened to the attachment base plates.

4 Claims, 4 Drawing Sheets

METHOD OF ATTACHING WINDOW UNITS

This is a division of application Ser. No. 516,316, filed July 22, 1983 now abandoned.

BACKGROUND OF THE INVENTION

1. Field of the Invention

The present invention relates to a method of mounting a window unit in a building opening.

2. Description of the Prior Art

It has been a conventional practice to mount a rectangular window unit in an opening in a building wall by placing the window unit in the opening, inserting a liner between a bottom rail of the window unit and a sill of the opening to position the window unit properly in the opening, and then welding an anchor mounted on the bottom rail to a joint bar joined to the sill. With such a prior arrangement, it is tedious and time-consuming to level the window unit with the building opening, and the bottom rail of the window unit as attached in position tends to be undulated due to level errors caused by the welds after the liner has been removed. To prevent this difficulty, it has been necessary to exert serious efforts to install window units with precision.

SUMMARY OF THE INVENTION

It is an object of the present invention to provide a method of mounting a window unit in a building opening.

According to the present invention, at least one adjustable anchor is attached to one of the rails of a window unit to be mounted in a building opening. After the window unit has been placed in the building opening, the adjustable anchor is adjusted to adjust the window unit in position between opposite edges of the building opening. Then, the adjustable achors are welded or otherwise fixed to an attachment base plate mounted on corresponding edge of the building opening. The adjustable anchor comprises an attachment block secured to the rail of the window unit and an adjustment bolt threaded in an internally threaded opening in the attachment block or a nut secured to the attachment block, the adjustment bolt having a bolt head held against and welded to the attachment base plate.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Throughout the specification, the terms "inner", "outer", "inwardly", and "outwardly" are used with reference to the geometric center of a building to which windows are to be attached.

Figure 1:
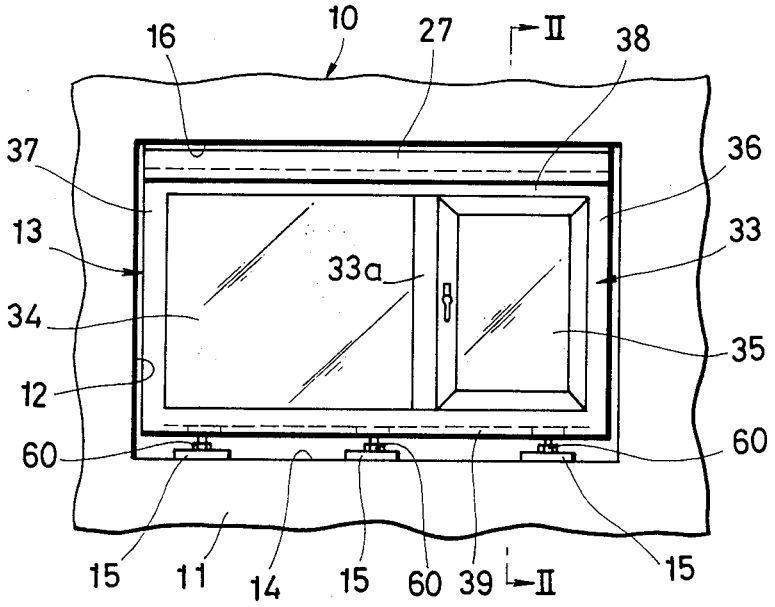
FIG. 1 is a front elevational view of a window unit mounted in a building opening with adjustable attachment anchors according to the present invention.
Figure 2:
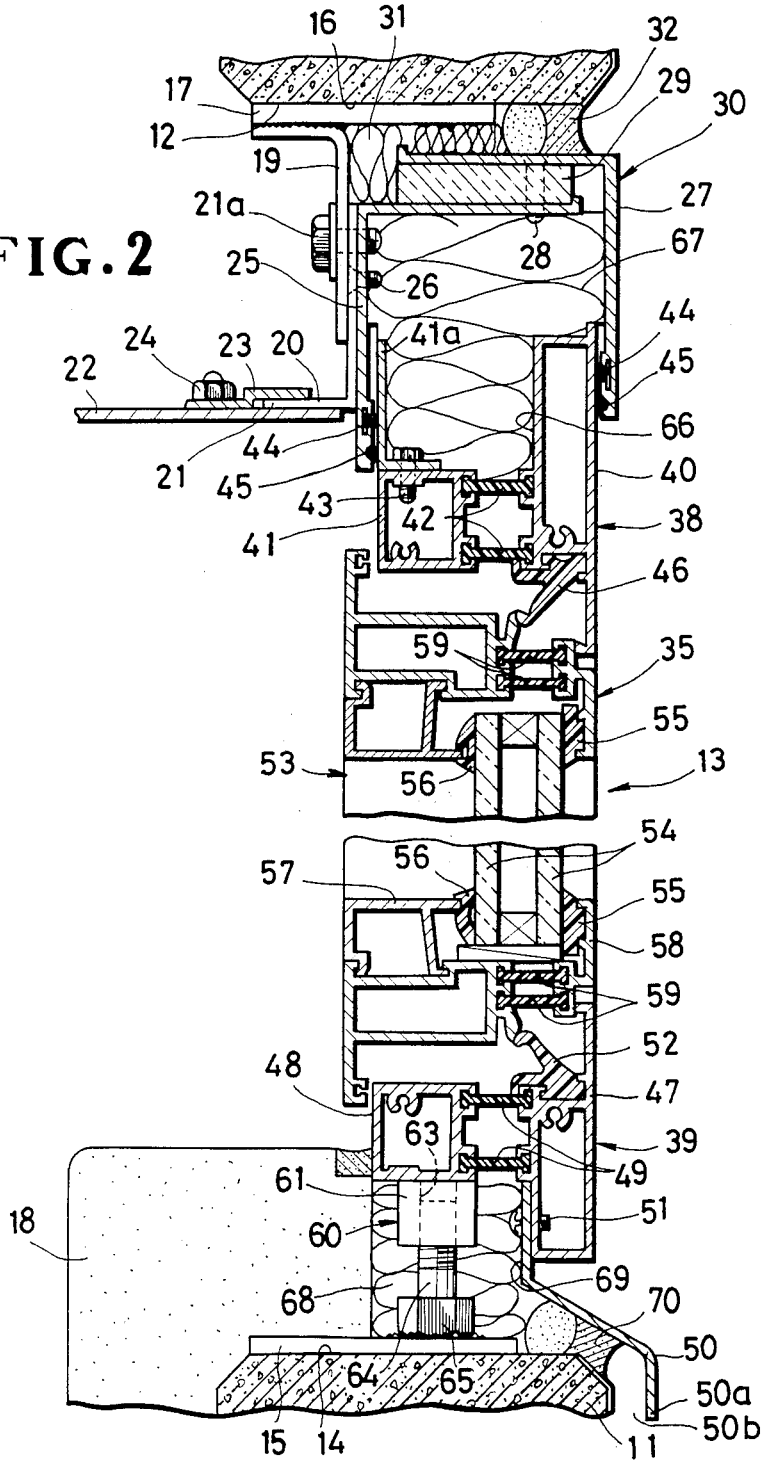
FIG. 2 is an enlarged cross-sectional view taken along line II—II of FIG. 1.

As shown in FIGS. 1 and 2, a building 10 has an outer building wall 11 with a substantially rectangular opening 12 therein, there being a window unit 13 installed in the opening 12. The opening 12 has a lower edge 14 on which a plurality of lower attachment base plates 15 are mounted at suitably spaced intervals.

As illustrated in FIG. 2, another or upper attachment base plate 17 is secured to an upper edge 16 of the opening 12. An interior siding 18 is attached to the building wall 11 below the opening 12 and covers inner portions of the lower attachment base plates 15. An L-shaped angle 19 is welded or otherwise fastened to the upper attachment base plate 17 on its inner marginal edge and has a vertical fin projecting downwardly into the opening 12. The L-shaped angle 19 extends longitudinally along the attachment base plate 17.

An L-shaped bracket 20 is fastened to the vertical fin of the angle 19 by means of screws 21*a* (one shown) and includes an inner horizontal fin 21. The inner horizontal fin 21 is mounted on a building ceiling 22 by a retainer 23 fixed by screws 24 (one shown) to the ceiling 22. An inner L-shaped frame member 25 is attached to the bracket 20 by means of the screws 21 and other screws 26 (not shown). An outer L-shaped frame member 27 is secured to the inner frame member 25 by means of screws 28 (one shown) with a thermal insulation member 29 interposed between horizontal plates of the frame members 25, 27. The inner and outer frame members 25, 27 thus interconnected jointly constitute a channel-shaped upper frame 30 which, as illustrated in FIG. 2, has a generally C-shaped cross-section and is attached by a conneection to the angle 19 to the upper edge 16 of the opening 12 with the C-shaped cross-section opening downwardly. Between the upper frame 30 and the attachment base plate 17, there is inserted a thermal insulation 31 of a soft fibrous material such as glass wool, rock wool or the like, which is retained in place by a caulking material 32.

As shown in FIG. 1, the window unit 13 is composed of a rectangular window frame 33 accommodating therein a fixed window assembly 34 and a swinging window assembly 35 with a vertical mullion 33*a* interposed therebetween. The rectangular window frame 33 is composed of a pair of side jambs 36, 37 and a pair of top and bottom rails 38, 39 interconnecting the side jambs 36, 37, the vertical mullion 33*a* extending between the top and bottom rails 38, 39.

As shown in FIG. 2, the top rail 38 comprises an outer rail member 40, an inner rail member 41, and a pair of thermal insulation members 42 interconnecting the outer and inner rail members 40, 41. An L-shaped flange 41*a* is fixed to the inner rail member 41 by means of screws 43 (one shown). The inner and outer frame members 25, 27 each carry a pair of airtight seals 44, 45 held against the outer rail member 40 and the flange 41*a*. The outer rail member 40 supports a resilient airtight sealing lip 46.

The bottom rail 39 is composed of an otuer rail member 47, an inner rail member 48, and a pair of thermal insulation members 49 interconnecting the outer and inner rail members 47, 48. A weathering board 50 is affixed to the outer rail member 47 by screws 51 (one shown). The weathering board 50 has a lower distal edge 50*a* spaced outwardly from the building wall 11 to provide a clearance 50*b*. The outer rail member 47 supports a flexible airtight sealing lip 52.

The swinging window assembly 35 comprises a window frame 53 accommodating therein a pair of spaced glass panes 54, 54 supported by airtight seals 55, 56 and including a pair of inner and outer frame members 57, 58 interconnected by thermal insulation members 59 positioned upwardly and downwardly of the glass panes 54, 54.

As shown in FIG. 1, the window unit 13 is supported by a plurality of adjustable attachments or anchors 60 welded to the attachment base plates 15, respectively.

Figure 3:
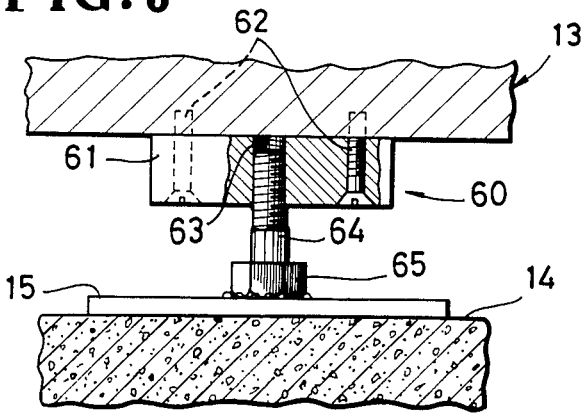
FIG. 3 is an enlarged cross-sectional view of an adjustable attachment anchor of the present invention.

As shown in FIGS. 2 and 3, each of the adjustable anchors 60 comprises a substantially square attachment block 61 secured by screws 62 to the window unit 13 and having a central internally threaded hole 63 with its axis directed perpendicularly to the upper and lower rails 38, 39, and an adjustment bolt 64 threaded in the central hole 63 in the attachment block 61 and having a bolt head 65 welded to one of the attachment base plates 15.

In FIG. 2, with the window unit 13 assembled in position, the upper frame 30 and the top rail 38 jointly define a space 66 accommodating therein a thermal insulation 67 of resilient material such as of glass wool or rock wool. The interior siding 18, the bottom rail 39, and the weathering board 50 jointly define a space 69 in which a thermal insulation 68 such as of glass wool or rock wool is accommodated and retained by a caulking material 70 filled between the weathering board 50 and the building wall 11.

Figure 5:
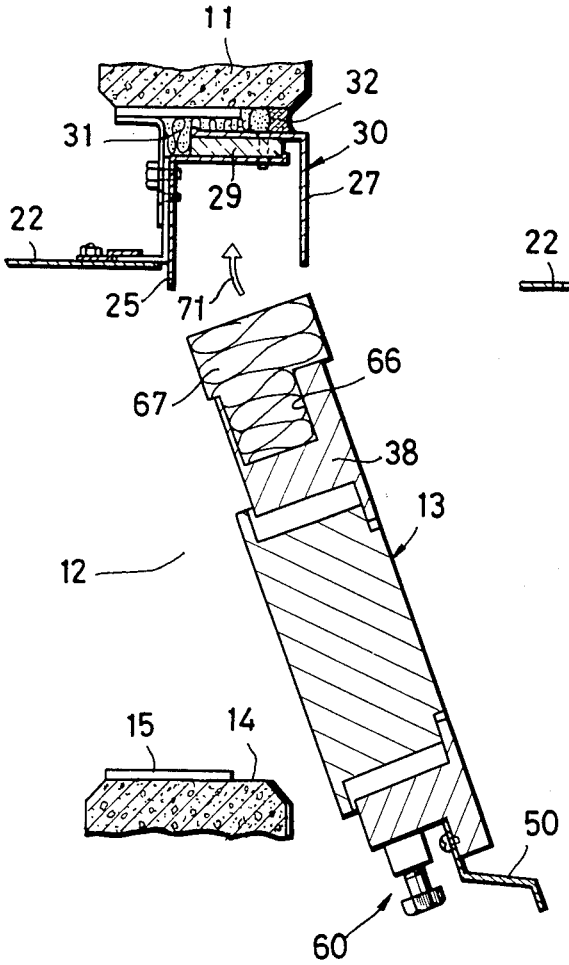
FIGS. 5 and 6 are vertical cross-sectional views showing the manner in which a window unit is installed in a building opening in accordance with the present invention.
Figure 6:
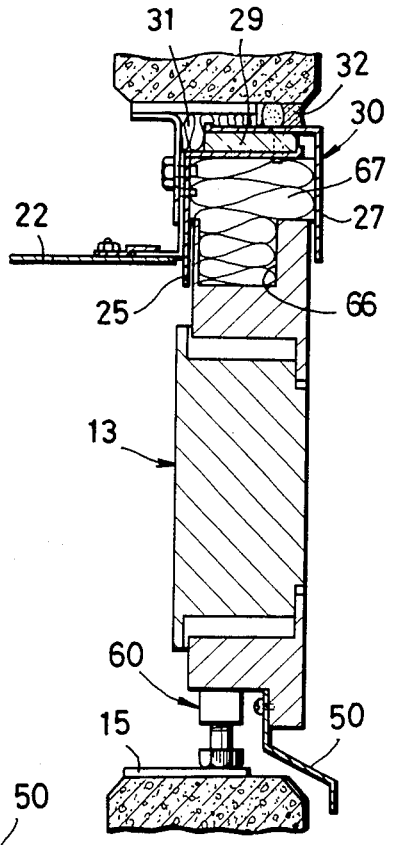

The window unit 13 can be installed in the building opening 12 as shown in FIGS. 5 and 6. First, the thermal insulation 67 is placed on the top rail 38. The window unit 13 is then lifted to bring the top rail 38 into the upper frame 30 in the direction of the arrow 71 (FIG. 5), and is displaced laterally inwardly into the opening 12 until the adjustable anchors 60 are placed on the attachment base plates 15 (FIG. 6). Thereafter, the adjustment bolts 64 are turned to adjust the window unit 13 in vertical position within the opening 12. The window unit 13 can be positionally adjusted inwardly or outwardly by sliding the adjustment bolts 64 on the attachment base plates 15. After the window unit 13 has been adjusted to a desired position in the opening 12, the bolt heads 65 are welded or otherwise secured to the attachment base plates 15. Then, the caulking material 70 is filled between the weathering board 50 and the building wall 11, the thermal insulation material 68 is placed in the space 69, and finally the interior siding 18 is applied to an inner surface of the building wall 11 to close the space 69.

With the foregoing arrangement, the window unit 13 can easily be leveled within the building opening 12, and can accurately be installed in the opening 12 simply by adjusting the adjustment bolts 64 even when the window unit 13 is approximately or roughly placed in the opening 12. Since the adjustable anchors 15 are spaced at intervals along the bottom rail 39, the window unit 13 is stably and securely held in position.

Figure 4:
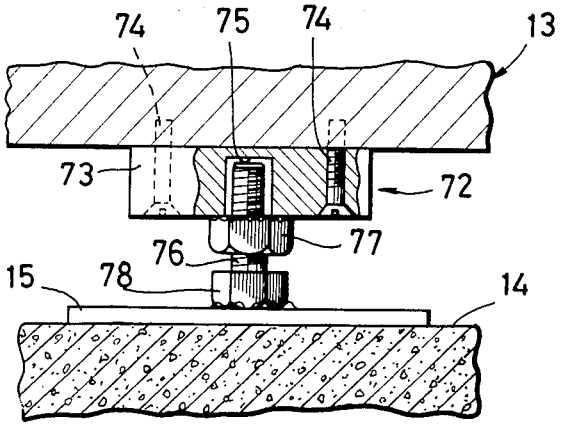
FIG. 4 is an enlarged cross-sectional view of another adjustable attachment anchor.

FIG. 4 illustrates an adjustable anchor 72 according to another embodiment of the present invention. The adjustable anchor 72 has a substantially square attachment block 73 fastened to the window unit 13 by screws 74 and having a central bottomed recess 75, an adjustment bolt 76 partly disposed in the central recess 75, and a nut 77 threaded over the adjustment bolt 76 and welded to the attachment block 73, the adjustment bolt 76 having a bolt head 78 welded to the attachment base plate 15. For installing the window unit 13 with such an adjustable anchor 72, the adjustable anchor 72 is placed on the attachment base plate 15, and the bolt 76 and the nut 77 are turned to adjust the vertical position of the window unit 13. Thereafter, the nut 77 is welded to both the attachment block 73 and the bolt 76, and the bolt head 78 is welded to the attachment base plate 15.

While in the illustrated embodiments the adjustable anchors 15 are used between the bottom rail 39 of the window unit 13 and the lower edge 14 of the opening 12, these adjustable anchors 15 can also be placed between the side jambs 36, 37 and lateral edges of the opening 12 for horizontally adjusting and supporting the window unit 13, particularly where the window unit 13 is of a large size which requires additional reinforcement.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A method of mounting a window unit in a building opening having an upper edge and a lower edge, said method comprising the steps of:

(a) providing a window unit having a top rail and a bottom rail;

(b) providing a channel-shaped upper frame having a generally C-shaped cross section and attaching the upper frame to said upper edge of the opening with the C-shaped cross-section opening downwardly;

(c) fixedly securing at least one adjustable anchor to said bottom rail of the window unit;

(d) attaching at least one attachment base plate to said lower edge;

(e) placing thermal insulation of resilient material on said top rail;

(f) subsequent to said placing of the thermal insulation of resilient material, inserting said top rail of the window unit into said upper frame so as to compress the thermal insulation;

(g) placing the adjustable anchor at a required position on the attachment base plate so as to allow the compressed thermal insulation to recover until a channel of the upper frame is filled with the thermal insulation;

(h) subsequent to said placing of the adjustable anchor, adjusting the adjustable anchor to an adjusted position for vertically adjusting the position of said window unit between the upper and lower edges of the building opening; and (i) finally, fixedly securing the adjustable anchor at said adjusted position by securing a portion of the anchor to the base plate.

2. A method according to claim 1, wherein said thermal insulation of resilient material is glass wool.

3. A method according to claim 1, wherein said thermal insulation is rock wool.

4. A method according to claim 1, which subsequent to the step of fixedly securing includes a step of inserting thermal insulation between the bottom rail and the lower edge of the opening and then sealing the insulation into a space therebetween.

* * * * *